United States Patent [19]

Matejec et al.

[11] Patent Number: 4,820,616

[45] Date of Patent: Apr. 11, 1989

[54] COLOR PHOTOGRAPHIC RECORDING MATERIAL

[75] Inventors: Reinhart Matejec; Manfred Becker; Heinrich Odenwälder, all of Leverkusen; Hans-Joerg Metz, Cologne, all of Fed. Rep. of Germany

[73] Assignee: Agfa-Gevaert Aktiengesellschaft, Leverkusen, Fed. Rep. of Germany

[21] Appl. No.: 13,427

[22] Filed: Feb. 11, 1987

[30] Foreign Application Priority Data

Feb. 22, 1986 [DE] Fed. Rep. of Germany ..... 3605713

[51] Int. Cl.[4] ..... G03C 1/06; G03C 7/26

[52] U.S. Cl. ..... 430/543; 430/505; 430/506; 430/551; 430/598; 430/611; 430/955

[58] Field of Search ..... 430/543, 955, 551, 598, 430/611, 505, 506

[56] References Cited

U.S. PATENT DOCUMENTS

| | | | |
|---|---|---|---|
| 4,021,248 | 5/1977 | Shiba et al. | 430/611 |
| 4,526,863 | 7/1985 | Mihayashi et al. | 430/553 |
| 4,656,123 | 4/1987 | Mihayashi et al. | 430/955 |

FOREIGN PATENT DOCUMENTS

| | | | |
|---|---|---|---|
| 0153039 | 8/1985 | Japan | 430/598 |
| 0153040 | 8/1985 | Japan | 430/598 |
| 2024253 | 2/1987 | Japan | 430/551 |
| 1007020 | 10/1965 | United Kingdom | 430/551 |

*Primary Examiner*—Paul R. Michl
*Assistant Examiner*—Lee C. Wright
*Attorney, Agent, or Firm*—Connolly & Hutz

[57] ABSTRACT

The sensitivity of highly sensitive color photographic recording materials may be enhanced by compounds releasing fogging or development accelerating compounds as a result of a reaction with color developer oxidation products and fogging may at the same time be reduced by using compounds corresponding to formula I as silver halide stabilizers:

I wherein

Z denotes the atoms required for completing an oxazole or oxazine ring and

Y denotes a condensed aromatic ring system having at least one aromatic ring optionally substituted with an acid group, or a substituent carrying an acid group.

5 Claims, No Drawings

COLOR PHOTOGRAPHIC RECORDING MATERIAL

This invention relates to a colour photographic recording material having at least one stabilized silver halide emulsion layer containing at least one compound which releases a fogging or development accelerating compound in the process of colour development.

It is known to produce coloured photographic images by chromogenic development, i.e. by developing imagewise exposed silver halide emulsion layers by means of suitable colour forming developer substances, so-called colour developers, in the presence of suitable colour couplers so that the oxidation product formed from the developer substances in areas corresponding to the silver image reacts with the colour coupler to form a dye image. The colour developers used are conventionally aromatic compounds containing primary amino groups, in particular those of the p-phenylenediamine series.

In developing further improvements in colour photographic recording materials it is an important aim to increase the photographic sensitivity. A sensitivity increase may be obtained by using larger silver halide grains but this measure is generally accompanied by a deterioration in colour graininess. Sensitivity may also be increased by using compounds which take part in the development process to release substances which increase development or produce fogging in imagewise distribution. Compounds of this kind are described, for example, in DE-A-32 09 110, DE-A-33 33 355, EP-A-0 117 511 and EP-A-0 118 087. The use of such compounds generally has the disadvantage of increasing the latent fog even in those areas which have not been exposed to light so that the images finally obtained have a more pronounced base veil.

It is an object of the present invention to provide highly sensitive colour photographic recording materials which have less tendency to fogging.

The present invention relates to a colour photographic recording material having at least one silver halide emulsion layer containing a binder and a non-diffusible compound associated with this layer, which compound is capable of reacting with the oxidation product of a colour developer to release a diffusible, fogging or development accelerating compound, and a silver halide stabilizer contained in the silver halide emulsion layer, characterised in that the silver halide stabilizer corresponds to the following general formula I

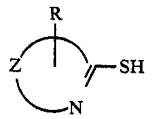

I wherein

Z denotes the atoms required for completing an oxazole or oxazine ring and

Y denotes a condensed aromatic ring system having at least one aromatic ring which may be substituted with an acid group, or a substituent containing an acid group.

The silver halide stabilizers used according to the invention are heterocyclic mercapto compounds in which the heterocyclic group contains at least one oxazole or oxazine ring. The following are examples of such heterocyclic groups: Oxazole, benzoxazole, naphth[1,2:d]oxazole, naphth[2,3:d]oxazole, naphth[2,1:d]oxazole, oxazine and naphth[1,8:de]oxazine. The oxazole and oxazine rings contain substituents with acid groups or condensed aromatic rings preferably having acid groups attached thereto. COOH, $SO_3H$, $SO_2$—NH—R (where R=H, alkenyl, aryl or acyl) are examples of acid groups.

Examples of silver halide stabilizers corresponding to formula I are given below.

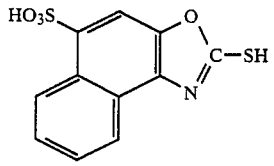

St-1

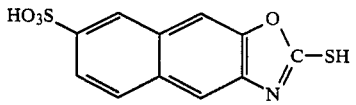

St-2

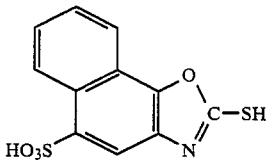

St-3

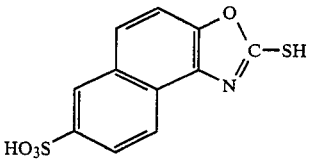

St-4

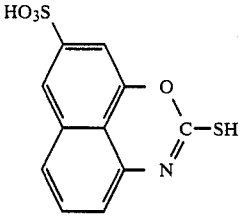

St-5

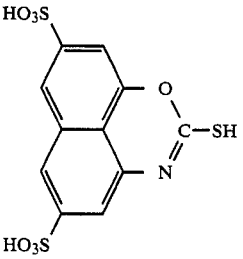

St-6

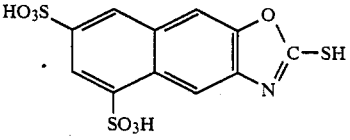

St-7

-continued

St-8

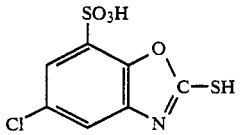

St-9

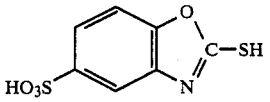

St-10

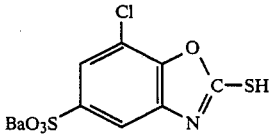

St-11

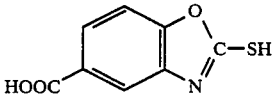

St-12

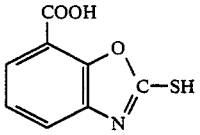

St-13

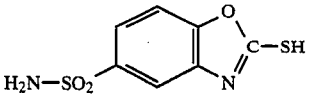

St-14

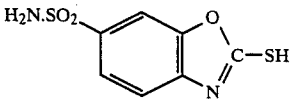

St-15

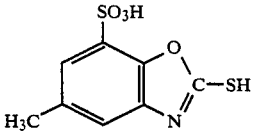

St-16

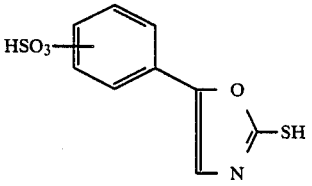

St-17

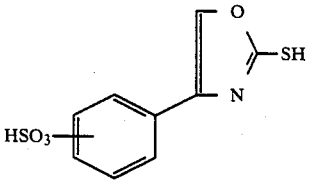

-continued

St-18

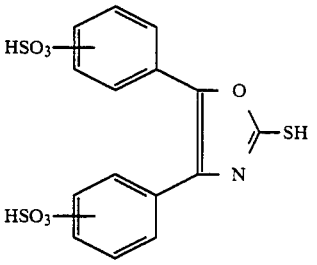

Compounds corresponding to formula I are known and have been described, for example, in DE-C-1 151 731.

The non-diffusible compounds contained in the recording material according to the invention and capable of releasing a diffusible, fogging or development accelerating compound as a result of development may be represented by the following general formula II

BALL—COUP—X—FA II wherein

BALL denotes a molecular residue of such a size and configuration that the whole molecule (formula II) can be incorporated in a diffusion-fast form in the binder matrix of a photographic recording material;

COUP denotes a group capable of entering into a coupling reaction with the oxidation product of a colour developer compound, either the residue FA or the residue BALL being split off in the process;

FA denotes the residue of a compound which has a fogging or development accelerating effect on the silver halide and X denotes a single chemical bond or a linking member.

In formula II, the group COUP denotes the residue of a coupler compound which may be, for example, a cyan coupler, a magenta coupler or a yellow coupler or a compound which reacts with colour developer oxidation products to form substantially colourless products. When COUP is a cyan coupler it may have, for example, the structure of a phenol or naphthol corresponding to one of the following formulae III and IV:

III

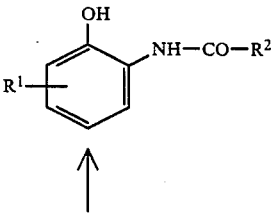

IV

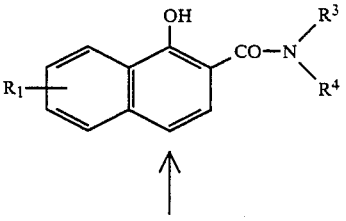

wherein $R^1$ denotes one, two or three identical or different substituents from the group comprising halogen, alkyl, alkoxy or alkylamino;

$R^2$ denotes alkyl, aralkyl, aryl or NH—aryl;

$R^3$ denotes alkyl, aralkyl or aryl;

$R^4$ denotes hydrogen or a group such as $R^3$.

When COUP is a magenta coupler it may have, for example, the structure of a pyrazolone corresponding to formula V or of a pyrazole azole corresponding to formula VI:

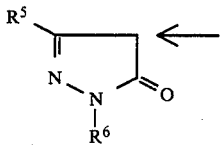

V

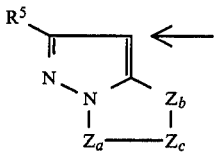

VI wherein $R^5$ denotes alkyl, aryl, alkoxy, amino or acylamino;

$R^6$ denotes alkyl, aryl or a heterocyclic group and $Z_a$, $Z_b$ and $Z_c$ each denotes an optionally substituted methine group, =N— or —NH—.

When COUP is a yellow coupler it may have, for example, a structure corresponding to formula VII

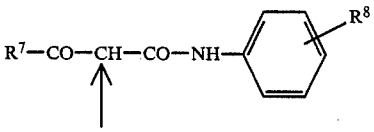

VII wherein $R^7$ denotes alkyl or aryl and $R^8$ denotes one, two or three identical or different substituents taken from the group comprising hydroxyl, halogen, alkoxy, amino, acylamino, carbamoyl, sulphamoyl, alkoxycarbonyl, carboxyl and sulpho.

Furthermore, COUP may have, for example, a structure corresponding to one of the formulae VIII or IX:

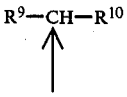

VIII wherein $R^9$ denotes carbamoyl, sulphamoyl, —CO—$R^6$, —$SO_2$—$R^6$, —CN, —CHO,

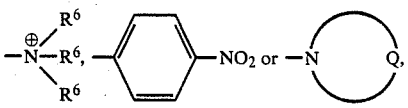

wherein Q denotes a group required for completing a 5- or 6-membered heterocyclic ring, e.g. a tetrazole ring, $R^{10}$ denotes hydrogen or a group such as $R^9$ or $R^9$ (e.g. —CO—$R^6$) and $R^{10}$ together form the residue for completing a 5- or 6-membered ring, e.g. an indanone ring;

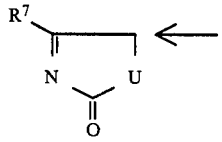

IX wherein $R^7$ has the meaning indicated for formula VII and

U denotes an oxygen atom, a sulphur atom or an imino group.

In formulae III to IX, the coupling position is indicated by an arrow (→). That is the position to which either the residue BALL or the residue —X—FA is attached. The other residue is then attached in a non-coupling position in the residue COUP represented by formulae III to IX.

The residue BALL in formula II may be described as a ballast group. This has the function of keeping the residue FA fast to diffusion in the layer of binder so long as it remains attached to BALL but enabling it to diffuse freely once it has been split off.

Ballast groups may be regarded as groups which enable compounds of formula II used according to the invention to be incorporated in a diffusion-fast form in the hydrophilic colloids conventionally used in photographic materials. Particularly suitable groups for this purpose are organic groups generally containing straight chained or branched aliphatic groups having 8 to 20 carbon atoms and optionally also containing carbocyclic or heterocyclic and optionally aromatic groups. These groups are attached to the remainder of the molecule either directly or indirectly, e.g. through one of the following groups: O, S, CO, $SO_2$, NR, CONR and $SO_2NH_2$, R denoting hydrogen or alkyl or aryl.

The connecting link denoted by X in formula II may be a temporary link, especially if it is attached at the coupling position of COUP, i.e. it may be a so-called timing group or control group which is initially released together with FA in the coupling reaction and is subsequently split off from FA so that FA can develop its fogging or development accelerating action. Such timing groups or control groups have been disclosed, e.g. in DE-A-27 03 145, DE-A-28 55 697, DE-A-27 03 145, DE-A-28 55 697, DE-A-31 05 026, DE-A-33 19 428, DE-A-35 18 231 and DE-A-35 18 797, in which they are described as time controlling connecting links between a coupler group and an inhibitor group. The compounds of formula II, however, need not necessarily contain such time controlling connecting links and when X is a single chemical bond the group FA may also be directly attached in a coupling or non-coupling position of COUP.

The group FA in formula II is the residue of a compound which if present in a diffusible form exerts a fogging or development accelerating effect on the silver halide. Suitable compounds for this purpose include, for example, compounds containing a thiourea, thioamide, thiocarbamate, rhodanine or thiohydantoin group or especially a hydrazine, acylhydrazine or hydrazone group. Particularly valuable are those compounds of formula II in which group FA contains a group AD which promotes the adsorption on silver halide in addition to a group with fogging action so that the group FA can optimize its fogging action on the silver halide when it has been split off from COUP. Suitable examples of groups AD include in particular heterocyclic rings containing nitrogen and a dissociable hydrogen atom, e.g. pyrazole, imidazole, triazole, tetrazole, benzimidazole, benzotriazole or heterocyclic rings having a mercapto group attached thereto, e.g. mercaptotetrazole, mercaptotriazole, mercaptobenzimidazole, mercaptopyrimidine, mercaptobenzoxazole or mercaptobenzothiazole. The group FA is generally connected to X or COUP through AD.

The compound releasing a fogging agent may also be one which releases the fogging agent in an oxidation-reduction reaction with an oxidation product of a developer, for example as described in DE-A-34 41 823.

Examples of suitable compounds according to the present invention releasing a fogging agent are shown below:

K-1

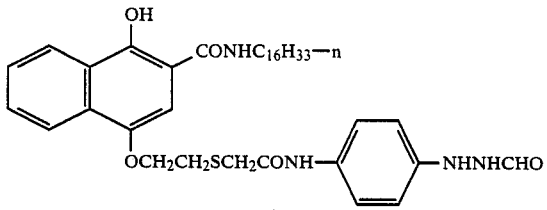

K-2

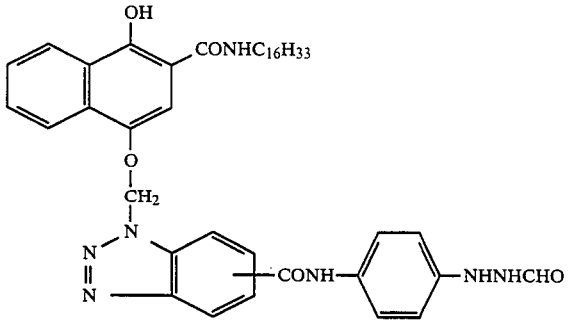

K-3

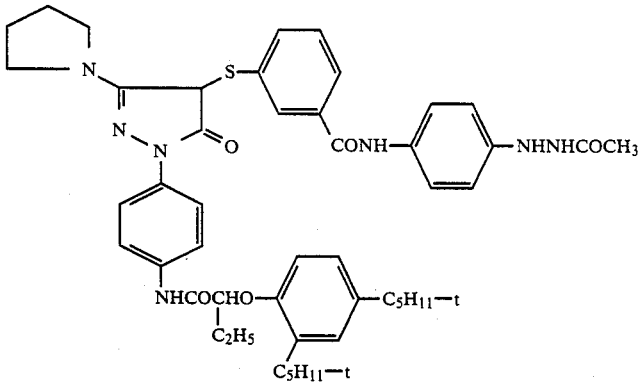

K-4

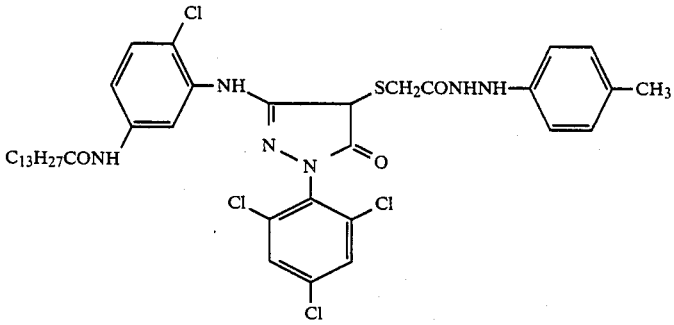

-continued
K-5
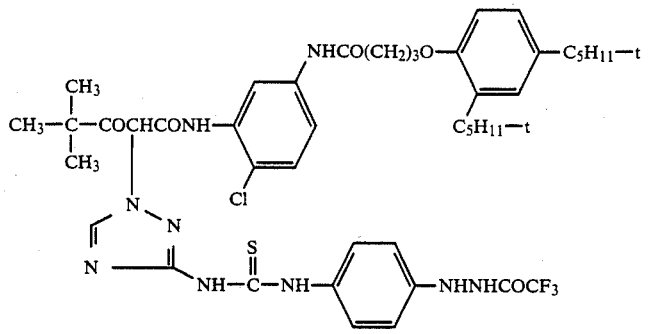
K-6
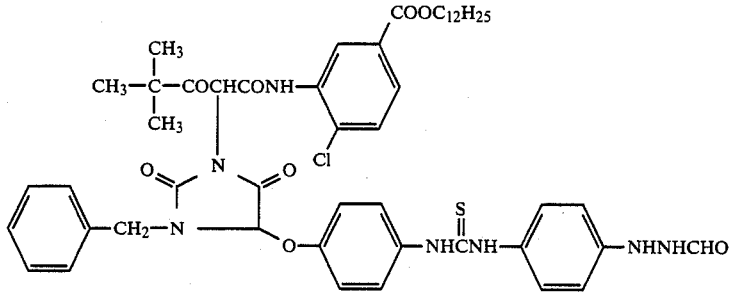
K-7
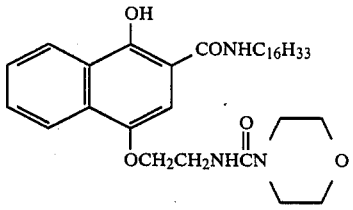
K-8
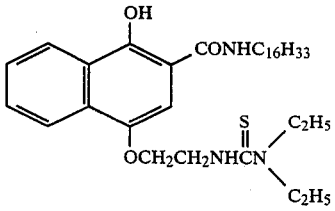
K-9
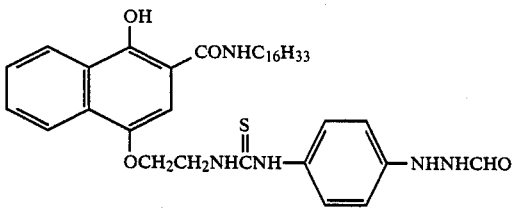
K-10
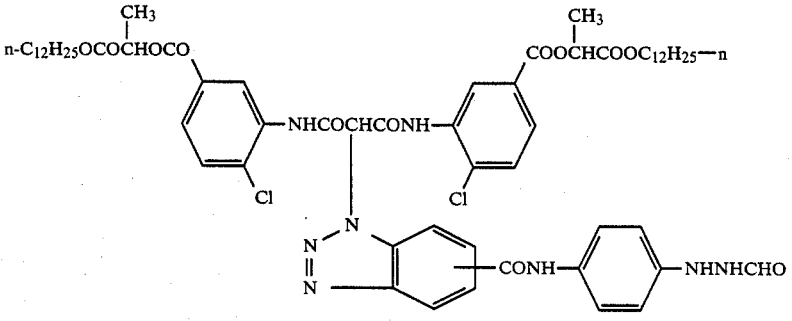

-continued
K-11
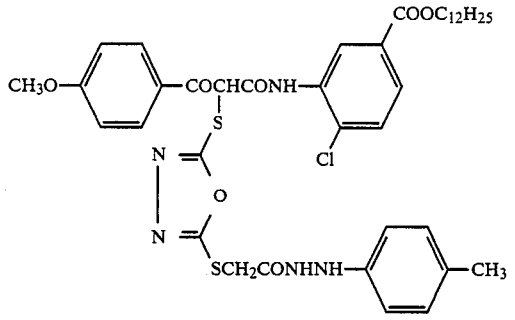
K-12
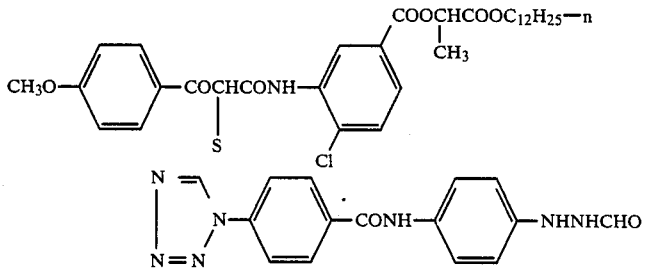
K-13
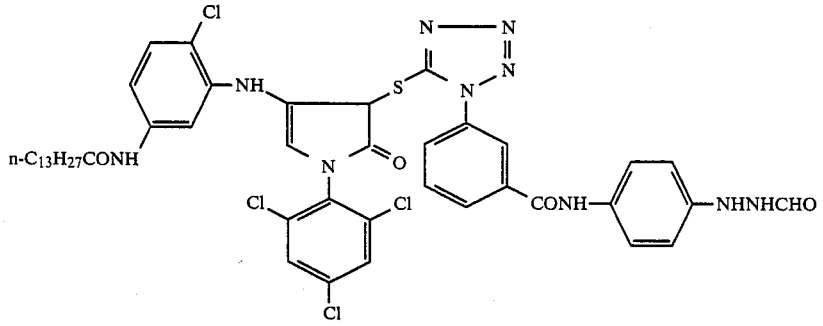
K-14
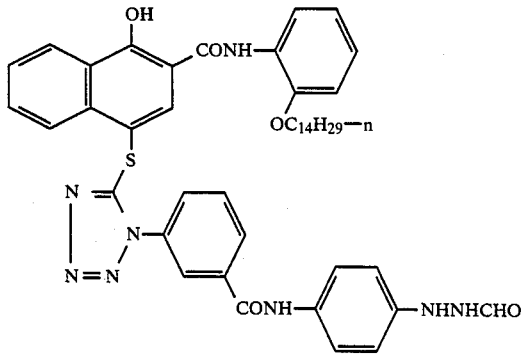

-continued
K-15
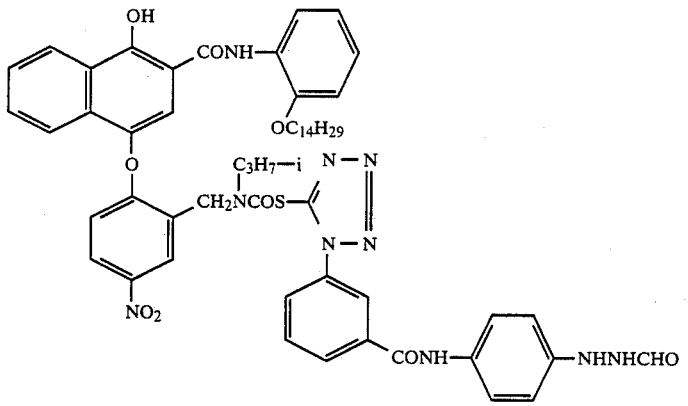
K-16
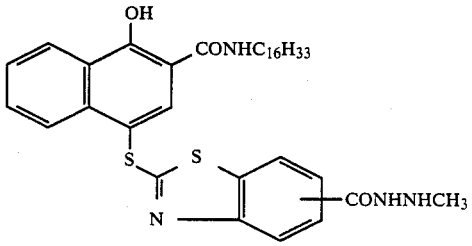
K-17
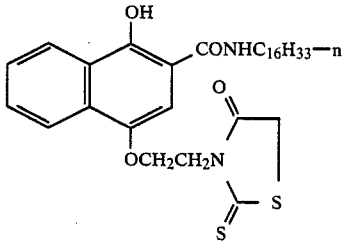
K-18
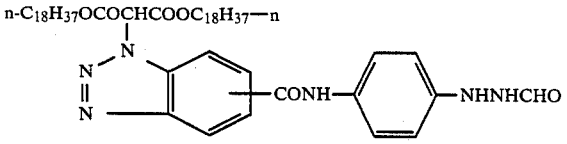
K-19
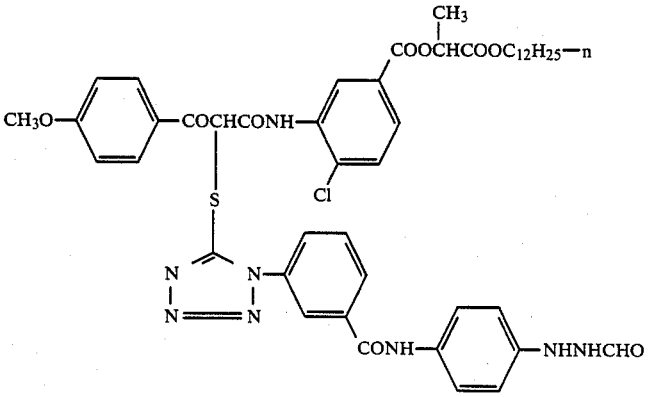

-continued
K-20
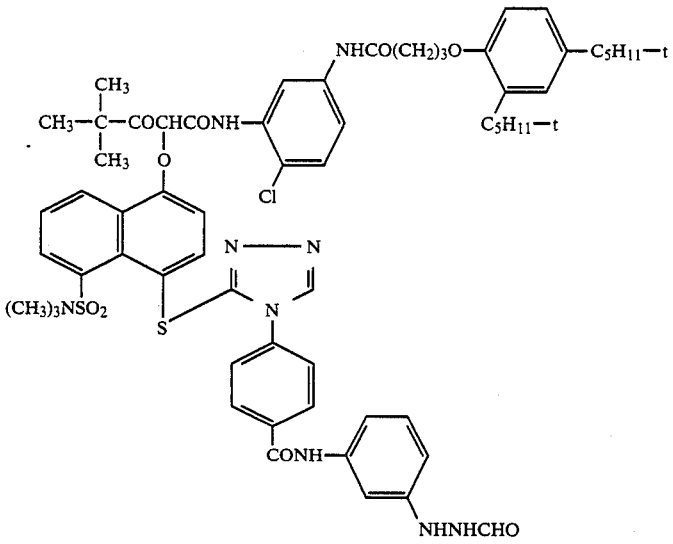
K-21
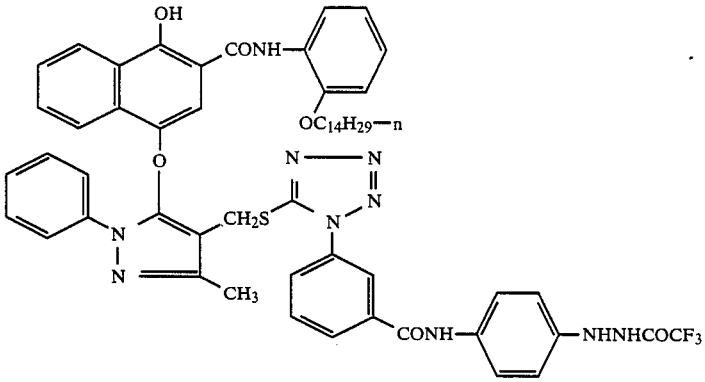
K-22
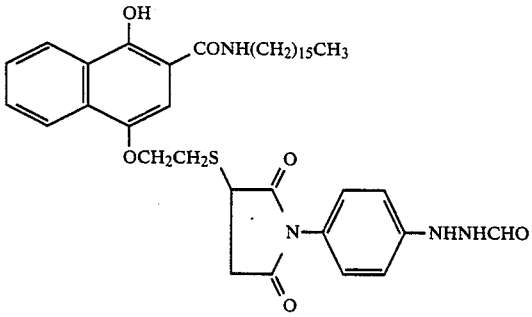
K-23
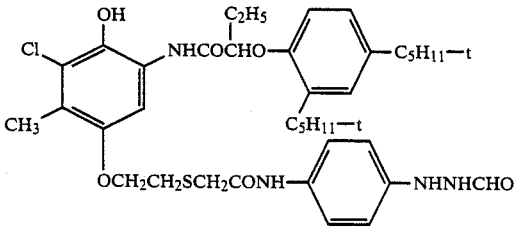

-continued
K-24
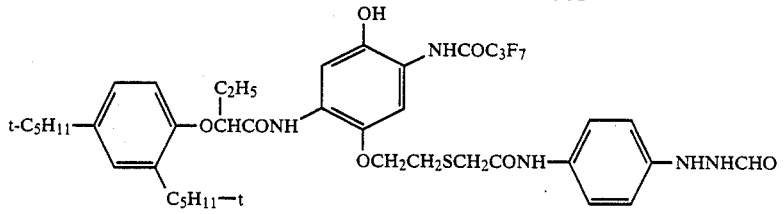
K-25
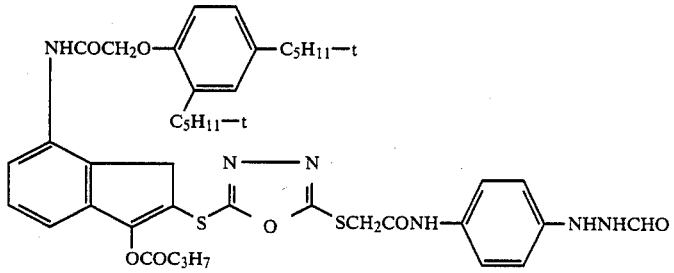
K-26
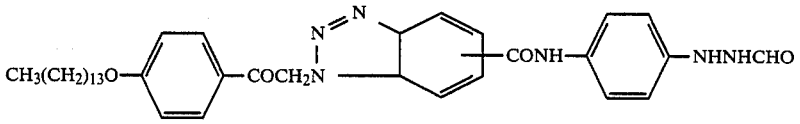
K-27
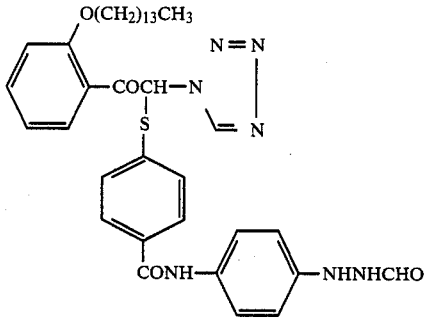
K-28
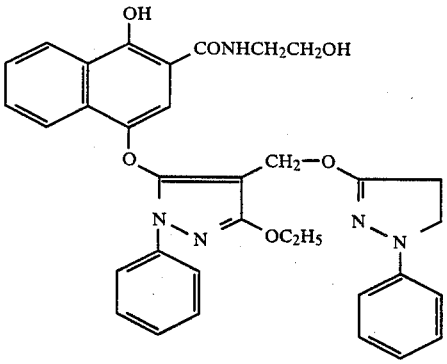
K-29
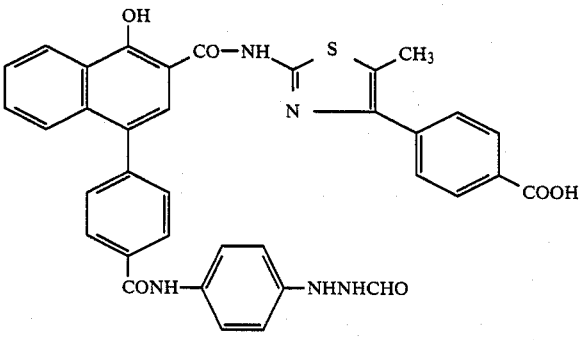

-continued
K-30
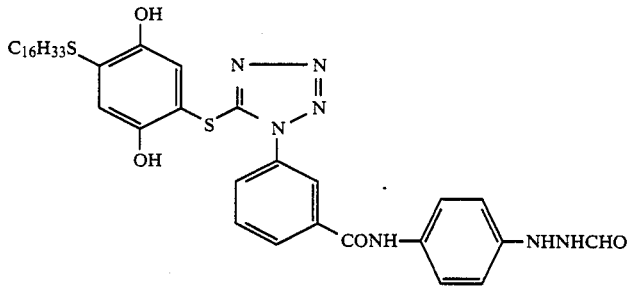
K-31
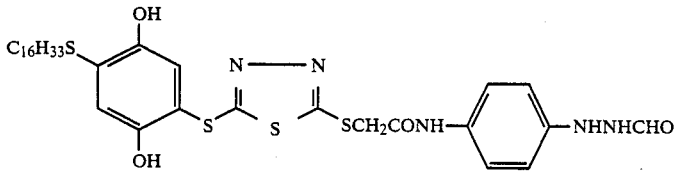
K-32
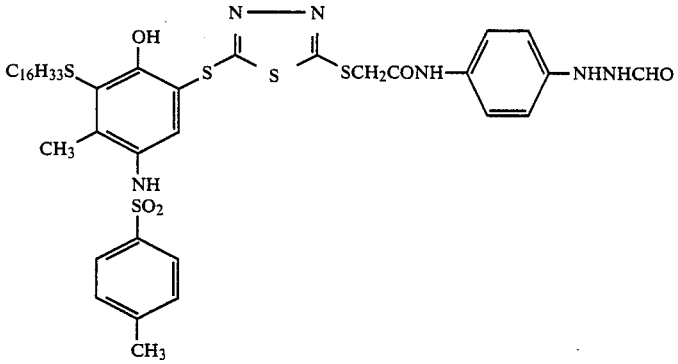
K-33
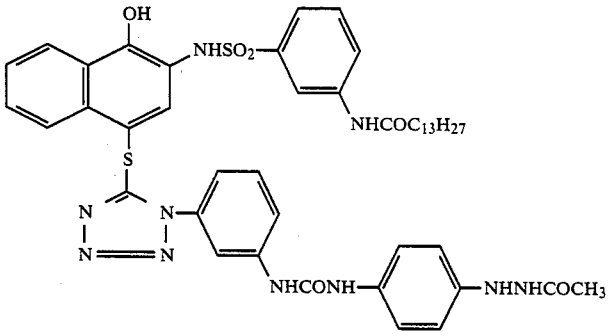
K-34
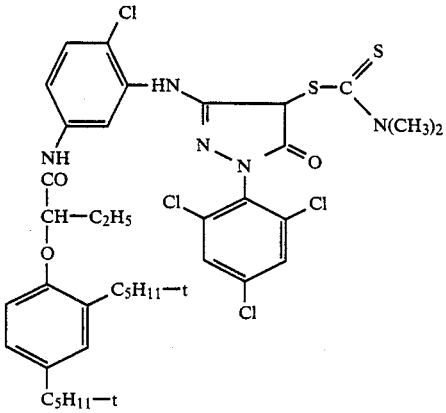

-continued

K-35

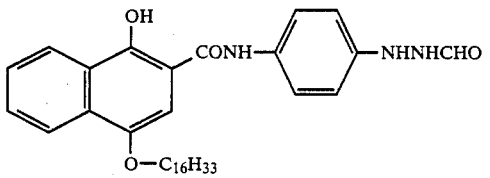

The compounds of formula II may advantageously be used to produce highly sensitive colour photographic recording materials in which the sensitivity is substantially increased and in particular the relationship between sensitivity and colour graininess is improved but the increase in sensitivity is obtained at the expense of an increase in colour fog. It has been found according to the invention that the colour fog can be substantially reduced by using the compounds of formula II in combination with the silver halide stabilizers of formula I. The use of this combination has the added advantage of increasing the stability in storage.

The combined use of compounds of formula I with compounds of formula II not only reduces fogging but may result in a further increase in sensitivity, especially in the high sensitivity region, and this additional gain in sensitivity is greater than any that can be obtained when combinations with other known stabilizers are used.

Optimum results are obtained when the silver halide stabilizer is used in a quantity of 10 to 300 mg per 100 g of $AgNO_3$ and the compound of formula II is used in a quantity of 0.1 to 10 g per 100 g of $AgNO_3$ in cases where the group FA in formula II does not contain a group AD or in a quantity of 0.005 to 1 g per 100 g of $AgNO_3$ in the preferred case of using a compound of formula II in which the group FA carries a group which is adsorbed on silver halide. The optimum quantity to be used in any individual case may lie outside the ranges indicated above but may always be determined by simple routine tests.

Addition of the compounds according to the invention may be carried out by the usual methods. Since the compounds of formula I contain acid groups they may generally be used in the form of aqueous, aqueous-alkaline or aqueous-alcoholic solutions and added to the casting solutions. They are generally added to a silver halide emulsion, preferably before the addition of couplers. The compounds of formula II may be used in a silver halide emulsion layer or in a layer of binder adjacent thereto. These compounds are generally hydrophobic and may be introduced into the layer by one of the usual emulsifying techniques. Since these compounds are generally used in layers containing (additional) colour producing compounds, e.g. colour couplers, they are advantageously incorporated together with these compounds in the form of mutual dispersions. Since the fogging or development accelerating compounds released from the compounds of formula II are intended to act on the silver halide, the compounds of formula II are preferably directly incorporated in a silver halide layer.

The halide in the light-sensitive silver halide emulsions may be a chloride, bromide or iodide or a mixture thereof. In a preferred embodiment, the halide content of at least one layer is composed of 0 to 12 mol-% of iodide, 0 to 50 mol-% of chloride and 50 to 100 mol-% of bromide. In a preferred embodiment, the halide consists predominantly of compact crystals, e.g. crystals with cubic, octahedral or transitional forms. They may be characterised by generally having a thickness greater than 0.2 μm. The average ratio of diameter to thickness is preferably less than 8:1, the diameter of a grain being defined as the diameter of a circle having the same surface area as the projected surface of the grain. In another preferred embodiment, all or some of the emulsions may contain mainly tabular silver halide crystals having a ratio of diameter to thickness greater than 8:1. The emulsions may be monodisperse emulsions with an average grain size preferably from 0.3 μm to 1.2 μm. The silver halide grains may have a layered grain structure.

The usual hydrophilic film-forming agents are suitable for use as protective colloids or binders for the layers of recording material, e.g. proteins, in particular gelatine, although this may be partly or completely replaced by other natural or synthetic binders. Casting auxiliaries and softeners may be used, see Research Disclosure 17 643 (December 1978), in particular Chapters IX, XI and XII.

The emulsions may be chemically and/or spectrally sensitized in the usual manner, they may contain other stabilizers in addition to the silver halide stabilizers of formula I and the emulsion layers as well as other, light-insensitive layers may be hardened with known hardeners in the usual manner. Suitable chemical stabilizers, spectral sensitizing dyes, stabilizers and hardeners are described, for example, in Research Disclosure 17 643; see in particular Chapters III, IV, VI and X.

Colour photographic recording materials normally contain at least one silver halide emulsion layer for recording light from each of the three spectral regions, red, green and blue. The light-sensitive layers are spectrally sensitized with suitable sensitizing dyes for this purpose in a known manner although blue-sensitive silver halide emulsion layers need not necessarily contain a spectral sensitizer since the intrinsic sensitivity of the silver halide is in many cases sufficient for recording the blue light.

Each of the above mentioned light-sensitive layers may consist of a single layer or be composed of two or more silver halide emulsion partial layers in a known manner e.g. as in the so-called double layer arrangement (DE-C-1 121 470). Red-sensitive silver halide emulsion layers are normally arranged closer to the layer support than the green sensitive silver halide emulsion layers which in turn are arranged closer to the support than the blue-sensitive layers, and a light-insensitive yellow filter layer is generally placed between the green-sensitive layers and the blue-sensitive layers, although other arrangements could also be used. A light-insensitive intermediate layer is generally arranged between layers differing in their spectral sensitivity, and these intermediate layers may contain means for preventing accidental diffusion of developer oxidation products. If a material contains a plurality of silver halide emulsion layers of the same spectral sensitivity, these may be arranged adjacent to one another or they may be separated by a light-sensitive layer of a different spectral sensitivity (DE-A-1 958 709, DE-A-25 30 645, DE-A-26 22 922). Such silver halide layers all having the same spectral sensitivity generally differ in their sensitivity to light (speed), and the more highly sensitive partial layers are generally arranged further away from the layer support than less sensitive partial layers having the same spectral sensitivity. In such recording materials, the combination according to the invention is preferably used in the most highly sensitive partial layers.

Colour photographic recording materials for the production of multicolour images generally contain colour producing compounds in spatial and spectral association with the silver halide emulsion layers of differing spectral sensitivities, these compounds including in particular colour couplers for producing the various partial colour images in cyan, magenta and yellow.

By spatial association is meant that the colour coupler is in such a spatial relationship to the silver halide emulsion layer that the coupler and the layer are capable of interacting so that an imagewise correspondence can be obtained between the silver image resulting from development and the colour image obtained from the colour coupler. This is generally achieved by arranging the colour coupler either in the silver halide emulsion layer or in an optionally light-insensitive layer of binder adjacent thereto.

The term "spectral association" means that the spectral sensitivity of each of the light-sensitive silver halide emulsion layers and the colour of the partial colour image produced from the colour coupler which is spatially associated are related to one another in a particular manner so that each of the spectral sensitivities (red, green, blue) is associated with a partial colour image of a different colour (generally, for example, the colours cyan, magenta and yellow in this sequence).

Each of the silver halide emulsion layers which are sensitized to different regions of the spectrum may be associated with one or more colour couplers. Where there is a plurality of silver halide emulsion layers having the same spectral sensitivity, each of these layers may contain a colour coupler and the colour couplers of these layers need not necessarily be identical, provided only that they all give rise at least to approximately the same colour on development, normally a colour which is complementary to the colour of the light to which the particular silver halide emulsion layers are predominantly sensitive.

In preferred embodiments, therefore, red-sensitive silver halide emulsion layers are associated with at least one non-diffusible colour coupler for producing the cyan partial colour image, generally a coupler of the phenol or α-naphthol series; green-sensitive silver halide emulsion layers are associated with at least one non-diffusible colour coupler for producing the magenta partial colour image, normally a colour coupler of the 5 -pyrazolone series or of the indazolone series or one of the various pyrazole-azoles (such pyrazole-azoles are described, for example, in DE-A-35 16 996); and blue-sensitive silver halide emulsion layers are associated with at least one non-diffusible colour coupler for producing the yellow partial colour image, generally a colour coupler containing an open chain keto methylene group. Many colour couplers of this kind are known and have been described in numerous Patent Specifications; see, for example, the publications entitled "Farbkuppler" by W. PELZ in "Mitteilungen aus den Forschungslaboratorien der Agfa, Leverkusen/-München", Volume III, page 111 (1961) and the publication by K. VENKATARAMAN in "The Chemistry of Synthetic Dyes", Vol. 4, 341 to 387, Academic Press (1971).

The colour couplers may be either conventional 4 -equivalent couplers or 2-equivalent couplers which require a smaller quantity of silver halide for colour production. 2-Equivalent couplers are derived, as is known, from 4-equivalent couplers in that their coupling position carries a substituent which is split off in the coupling reaction. 2-Equivalent couplers include both compounds which are virtually colourless and those which have an intense colour of their own which disappears in the process of colour coupling to be replaced by the colour of the resulting image dye. The last mentioned couplers may in addition be present in the light-sensitive silver halide emulsion layers where they serve as masking couplers to compensate for unwanted side densities of the image dyes. The 2-equivalent couplers also include the known white couplers which do not give rise to a dye in their reaction with colour developer oxidation products. Also to be included among the 2 -equivalent couplers are the known DIR couplers in which the coupling position carries a removable group which is released as diffusible development inhibitor when the coupler reacts with colour developer oxidation products. The couplers, including the compounds of formula II used according to the invention, may also be employed in a polymeric form, e.g. as polymer latex.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. High molecular weight colour couplers are generally prepared by the polymerisation of ethylenically unsaturated monomeric colour couplers. In compounds of formula II, the group BALL then contains a segment of a polymer structure.

The colour couplers used may also be of the kind which give rise to dyes which have a slight or restricted mobility.

By slight or restricted mobility is meant a mobility of such a degree that the contours of the discrete colour patches produced on chromogenic development are diffuse and merge into one another. This degree of mobility should be distinguished from the usual complete immobility in photographic layers, which is desired for the colour couplers or dyes produced from them in conventional photographic recording materials to enable a very sharp image to be obtained and it should also be distinguished from the complete mobility of dyes such as is desired, for example, in the dye diffusion process. The last mentioned dyes generally contain at least one group which renders them soluble in an alkaline medium. The degree of slight mobility desired according to the invention may be controlled by varying the substituents, for example so as to vary in a controlled manner the solubility in the organic medium of the oil former or the affinity for the binder matrix.

In addition to the components mentioned above, the colour photographic recording material according to the present invention may contain other additives, e.g. antioxidants, dye stabilizers and agents which influence the mechanical and electrostatic properties. For the purpose of eliminating or reducing the adverse effects of UV light on colour images produced with the colour photographic recording material according to the invention it is advantageous, for example, to use UV absorbent compounds in one or more layers of the recording material, preferably in one of the upper layers. Suitable UV absorbents are described, for example, in US-A-3 253 921, DE-C-2 036 719 and EP-A-0 057 160.

For the production of colour photographic images, the colour photographic recording material according to the invention containing at least one silver halide emulsion layer and at least one coupler of formula I associated therewith is developed with a colour developer compound. The colour developer compounds used may be any developer compound which is capable of reacting in the form of its oxidation product with colour couplers to form azomethine dyes. Suitable colour developer compounds include aromatic compounds of the p-phenylenediamine series containing at least one primary amino group, e.g. N,N-dialkyl-p-phenylenediamines such as N,N-diethyl-p-phenylenediamine, 1-(N-ethyl-N-methyl-sulphonamidoethyl)-3-methyl-p-phenylenediamine, 1-(N-ethyl-N-hydroxyethyl-3-methyl-p-phenylenediamine and 1-(N-ethyl-N-methoxyethyl)-3-methyl-p-phenylenediamine.

EXAMPLE 1

Preparation of the layers 1000 g of a sulphur and gold ripened, spectrally red-sensitized silver iodobromide emulsion in which the grains consisted of an iodide-rich nucleus (15 mol-% $I^{\ominus}$) and an envelope with a lower iodide content (1 mol-% $I^{\ominus}$) and the mean total iodide content was 7 mol-% and the mean grain diameter 0.85 μm and which contained silver halide in a quantity equivalent to 100 g of $AgNO_3$ per kg and 40 g of gelatine per kg were stabilized with 0.6 mmol of comparison stabilizers V-1, V-2 and V-3 (samples 2 to 4) and the silver halide stabilizers according to the invention St-1, St-8 and St-11 (samples 5 to 7). One comparison sample (sample 1) was prepared without a stabilizer and another sample (sample 8) was prepared with a mixture of 0.4 mol of comparison stabilizer V-1 and 0.2 mmol of compound St-8.

A colour coupler emulsion containing 20 g of colour coupler corresponding to the formula

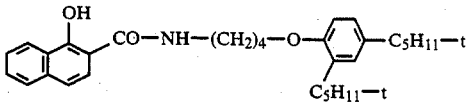

emulsified with 20 g of tricresylphosphate and 20 g of gelatine was added to each of these spectrally sensitized and stabilized emulsion samples 1 to 8.

One series of these emulsion/emulsion mixtures was used in each case without compounds of formula II of the invention, for comparison.

To a second series was added an emulsion containing 2.5 g of compound K-17 emulsified with 2.5 g of tricresylphosphate and 2.5 g of gelatine.

The casting solutions obtained as described were cast on a transparent layer support (silver halide application: 3.0 g $AgNO_3$per $m^2$).

The layers were covered with a protective layer of gelatine (0.5 μm thickness of dry layer) and hardened.

After imagewise exposure to red light for an exposure time of 1/100 behind a grey sensitometer wedge, the samples were processed by a colour negative process described in "The British Journal of Photography", 1974, pages 597 and 598.

The results (change in photographic sensitivity and fog) are entered in the accompanying Tables. The gain in sensitivity produced by the compound according to the invention when silver halide stabilizers according to the invention corresponding to formula I are used is greater and the increase in fogging less than that obtained with comparison stabilizers.

The following comparison stabilizers were used:

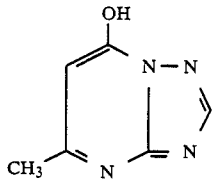

V-1

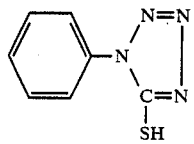

V-2

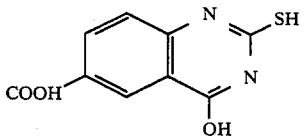

V-3

TABLE 1

| Sample | Sensitivity E [DIN] without Compound | with K-17 | ΔE | Fogging density D without Compound | with K-17 | ΔD |
|---|---|---|---|---|---|---|
| 1 | 18.0 | 16.0 | −2 | 0.39 | 0.93 | 0.54 |
| 2 | 22.3 | 23.8 | +1.5 | 0.20 | 0.40 | 0.20 |
| 3 | 20.6 | 21.2 | +0.6 | 0.11 | 0.15 | 0.04 |
| 4 | 23.7 | 25.0 | +1.3 | 0.14 | 0.30 | 0.16 |
| 5 | 24.4 | 27.5 | +3.1 | 0.12 | 0.16 | 0.04 |
| 6 | 24.0 | 27.2 | +3.2 | 0.11 | 0.13 | 0.02 |
| 7 | 24.5 | 27.4 | +2.9 | 0.13 | 0.17 | 0.04 |
| 8 | 23.2 | 26.7 | +3.5 | 0.15 | 0.18 | 0.03 |

EXAMPLE 2

Preparation of the layers 1000 g of a sulphur and gold ripened, spectrally red-sensitized silver iodobromide emulsion containing tabular grains (T grains; aspect ratio: 1/5, average grain diameter 1.6 μm) and containing per kg the quantity of silver halide equivalent to 100 g of $AgNO_3$ and 50 g of gelatine were stabilized with 1.0 mmol of the same stabilizers as in Example 1.

Emulsion samples 9 (without stabilizer), 10 to 12 (comparison stabilizers V-1, V-2 and V-3) and 13 to 16 (compounds St-1, St-8 and St-11 and mixtures of 2 parts of V-1 and 1 part of St-8) were thereby obtained.

A colour coupler emulsion containing 25 g of colour coupler corresponding to the formula

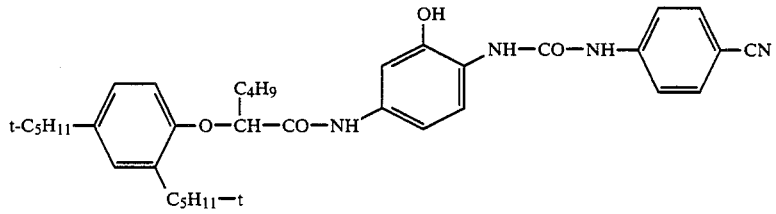

emulsified with 30 g of dibutylphthalate and 20 g of gelatine was added to each of the different samples of emulsion.

A second series was set up in which a corresponding colour coupler emulsion in addition containing 0.20 g of compound K-14 was added to each of the differently stabilized samples of emulsion.

The casting solutions obtained as described above were cast on a transparent layer support (silver halide application 2.0 g $AgNO_3$ per $m^2$, covered with a protective gelatine layer (0.5 μm dry layer thickness)) and hardened.

Exposure and processing were carried out as in Example 1 and the results are summarized in Table 2.

TABLE 2

| | Sensitivity E [DIN] | | | Fogging Density S | | |
|---|---|---|---|---|---|---|
| Sample | without Compound | with K-14 | ΔE | without Compound | with K-14 | ΔS |
| 9 | 19.5 | 18.2 | −1.3 | 0.54 | 1.16 | 0.62 |
| 10 | 24.1 | 24.8 | +0.7 | 0.34 | 0.65 | 0.31 |
| 11 | 21.8 | 22.1 | +0.3 | 0.12 | 0.18 | 0.06 |
| 12 | 26.2 | 27.8 | +1.6 | 0.19 | 0.41 | 0.22 |
| 13 | 26.5 | 30.8 | +4.3 | 0.20 | 0.20 | 0.05 |
| 14 | 27.0 | 31.2 | +4.2 | 0.13 | 0.15 | 0.02 |
| 15 | 27.0 | 31.0 | +4.0 | 0.14 | 0.19 | 0.05 |
| 16 | 26.3 | 29.5 | +3.2 | 0.16 | 0.22 | 0.06 |

We claim:

1. Color photographic recording material containing at least one silver halide emulsion layer containing binder and a non-diffusible compounds associated with this layer, which compound is capable of releasing a diffusible fogging or development accelerating compound as a result of a reaction with the oxidation product of a color developer compound, and said silver halide emulsion also containing a silver halide stabilizer, characterised in that the silver halide stabilizer corresponds to the following general formula I

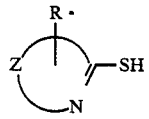

I wherein

Z denotes the atoms required for completing an oxazole or oxazine ring and

Y denotes a condensed aromatic ring system having at least one aromatic ring substituted with an acid group or Y denotes a substituent carrying an acid group.

2. Recording material according to claim 1, characterised in that the silver halide stabilizer (formula I) contains at least one carboxyl, sulphamoyl or sulpho group attached to an aromatic ring.

3. Recording material according to claim 1 or 2, characterised in that the non-diffusible compound which is capable of releasing a diffusible, fogging or development accelerating compound as the result of a reaction with the oxidation product of a colour developer compound corresponds to the following general formula II

BALL—COUP—X—FA II wherein

BALL denotes a molecule residue of such a size and configuration that the molecule as a whole (formula II) can be incorporated in a diffusion-fast form in the binder matrix of a photographic recording material;

COUP denotes a group capable of entering into a coupling reaction with the oxidation product of a colour developer compound, either the residue FA or the residue BALL being split off;

FA denotes the residue of a compound which acts of the silver halide to exert a fogging or development accelerating effect; and X denotes a single chemical bond or a connecting link.

4. Recording material according to claim 3, characterised in that COUP stands for the residue of a cyan coupler, a magenta coupler or a yellow coupler or the residue of a compound which reacts with colour developer oxidation products to form substantially colourless products.

5. Recording material according to one of the claims 1 or 2, characterised in that it contains at least two silver halide partial layers having the same spectral sensitivity, a combination of a compound of formula I and a compound of formula II being contained in the more highly sensitive or most highly sensitive partial layer.

* * * * *